US010325565B2

(12) United States Patent
Cao et al.

(10) Patent No.: US 10,325,565 B2
(45) **Date of Patent: *Jun. 18, 2019**

(54) ARRAY SUBSTRATE, DISPLAY PANEL AND LIQUID CRYSTAL DISPLAY DEVICE

(71) Applicants: Shanghai Tianma Micro-Electronics Co., Ltd., Shanghai (CN); Tianma Micro-Electronics Co., Ltd., Shenzhen (CN)

(72) Inventors: Zhaokeng Cao, Shanghai (CN); Zhongshou Huang, Shanghai (CN)

(73) Assignees: Shanghai Tianma Micro-Electronics Co., Ltd., Shanghai (CN); Tianma Micro-Electronics Co., Ltd., Shenzhen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 15/954,553

(22) Filed: Apr. 16, 2018

(65) Prior Publication Data

US 2018/0233101 A1 Aug. 16, 2018

Related U.S. Application Data

(63) Continuation of application No. 14/948,176, filed on Nov. 20, 2015, now Pat. No. 9,972,267.

(30) Foreign Application Priority Data

Jun. 30, 2015 (CN) ..... 2015 1 0375754

(51) Int. Cl.
*G09G 3/36* (2006.01)

(52) U.S. Cl.
CPC ... *G09G 3/3677* (2013.01); *G09G 2310/0281* (2013.01); *G09G 2310/0286* (2013.01)

(58) Field of Classification Search
None
See application file for complete search history.

(56) References Cited

U.S. PATENT DOCUMENTS 8,334,960 B2 12/2012 Yang et al.
2003/0045043 A1 3/2003 Koyama
(Continued)

FOREIGN PATENT DOCUMENTS

CN 1207194 A 2/1999
CN 1941063 A 4/2007
(Continued)

*Primary Examiner* — Joseph R Haley
(74) *Attorney, Agent, or Firm* — Faegre Baker Daniels LLP

(57) ABSTRACT

An array substrate includes a display region and a non-display region around the display region. The display region comprises a plurality of rows of pixel units arranged sequentially along a first direction and a plurality of gate scanning lines corresponding to the plurality of rows of the pixel units, respectively, and the gate scanning lines extend along a second direction. Cascaded first shift register units are disposed at at least one edge of the non-display region parallel to the second direction, and each of the first shift register units is connected with a corresponding one of the plurality of gate scanning lines; and cascaded second shift register units are disposed at at least one edge of the non-display region parallel to the first direction, and each of the second shift register units is connected with a corresponding one of the plurality of gate scanning line.

17 Claims, 11 Drawing Sheets

(56) References Cited

U.S. PATENT DOCUMENTS

| | | | | |
|---|---|---|---|---|
| 2010/0321372 | A1 | 12/2010 | Iwamoto et al. | |
| 2014/0028534 | A1* | 1/2014 | Park | G09G 3/34 345/84 |
| 2016/0351154 | A1* | 12/2016 | Xu | H03K 5/135 |

FOREIGN PATENT DOCUMENTS

| | | | |
|---|---|---|---|
| CN | 101281337 | A | 10/2008 |
| CN | 103579221 | A | 2/2014 |

* cited by examiner

ARRAY SUBSTRATE, DISPLAY PANEL AND LIQUID CRYSTAL DISPLAY DEVICE

CROSS-REFERENCE TO RELATED APPLICATION

This application is a continuation of U.S. application Ser. No. 14/948,176, filed Nov. 20, 2015, which claims priority to Chinese Application No. 201510375754.X, filed Jun. 30, 2015, both of which are herein incorporated by reference in their entirety.

TECHNICAL FIELD

The present disclosure relates to the field of liquid crystal display technologies and, in particular, to an array substrate, a display panel and a liquid crystal display device.

BACKGROUND

A Liquid Crystal Display (LCD) is typically a flat-panel display. With the development of science and technology, LCDs are being developed to be light-weight and thin, and have advantages such as a wide visual angle, low power consumption, a small thickness, and being free of radiation, which allow users to enjoy the best visual effect.

To display using the LCD display device, gates in a display region of the display device need to be driven. In an application field demanding a narrow frame for the display panel (for example in mobile phones), an approach to achieve the narrow frame is to drive the gates by an integrated gate driver. FIG. 1 is a schematic diagram of driving the gates by the integrated gate driver in the related art. As shown FIG. 1, an array substrate of the LCD display device includes a display region 10 and non-display regions 11, 12, 13, 14 surrounding the display region 10. The integrated gate driver is disposed in the non-display region 11 and includes a plurality of cascadedly-connected shift register units 111. An output terminal of each of the shift register units 111 is configured to output a drive signal for controlling a gate switch to a corresponding gate line 15 in the display region 10. As shown in FIG. 1, all the shift register units 111 are disposed in the non-display region 11. Of course, it is also possible that all the shift register units 111 are disposed in the non-display region 12. The following description is based on the space occupied by each shift register unit 111 being constant or the same. Because each of the shift register units 111 is connected to one corresponding gate line 15, the number of the shift register units 111 is the same as the number of rows of pixel units 16 in the display region 10. If the area occupied by each shift register unit 111 is denoted by S, the length of each shift register unit 111 along a first direction is denoted by L1, the length of each shift register unit 111 along a second direction is denoted by L2, and the length of the pixel unit 16 along the first direction is denoted by I1. The length L1 of each shift register unit 111 along the first direction is less than or equal to the length I1 of the pixel unit 16 along the first direction, thus the length L2 of each shift register unit 111 along the second direction meets $L2=S/L1\geq S/I1$. Therefore, the length of each shift register unit 111 along the second direction limits further narrowing of the frame of the display panel.

FIG. 2 is another schematic diagram of driving the gate by an integrated gate driver in the related art. Unlike in FIG. 1, a part of the shift register units 111 are disposed in the non-display region 11 while another part of the shift register units 111 are disposed in the non-display region 12, as shown in FIG. 2. The shift register units 111 in the non-display region 11 are configured to drive the odd-numbered gate lines, while the shift register units 111 in the non-display region 12 are configured to drive the even-numbered gate lines. In this arrangement shown in FIG. 2, the length L1 of each shift register unit 111 along the first direction meets $L1\leq 2I1$, thus the length L2 of each shift register unit 111 along the second direction meets $L2=S/L1\geq S/2I1$. Compared with the arrangement shown in FIG. 1, the arrangement shown in FIG. 2 reduces the length L2 of each of the shift register units 111 along the second direction. However, with the increasing demands for the narrow frame, the continuous narrowing of the frame of the display panel employing the integrated gate driver becomes more challenging.

SUMMARY

The present disclosure provides an array substrate, a display panel and a liquid crystal display device to narrow the frame of the panel.

In a first example, the disclosure provides an array substrate, including a display region and a non-display region around the display region;

the display region includes a plurality of rows of pixel units arranged sequentially along a first direction and a plurality of gate scanning lines corresponding to the plurality of rows of the pixel units, respectively, and the gate scanning lines extend along a second direction; cascaded first shift register units are disposed at at least one edge of the non-display region parallel to the second direction, and each of the first shift register units is connected with a corresponding one of the plurality of gate scanning lines; and cascaded second shift register units are disposed at at least one edge of the non-display region parallel to the first direction, and each of the second shift register units is connected with a corresponding one of the plurality of gate scanning lines.

In a second example, the disclosure provides a display panel including a color filter substrate and the array substrate according to the first example of the disclosure.

In a third example, the disclosure provides a liquid crystal display device including the display panel according to the second example of the disclosure.

In the technical solution of the disclosure, cascaded first shift register units are disposed at at least one edge of the non-display region parallel to the second direction, and each of the first shift register units is connected with a corresponding one of the plurality of gate scanning lines; and cascaded second shift register units are disposed at at least one edge of the non-display region parallel to the first direction, and each of the second shift register units is connected with a corresponding one of the plurality of gate scanning lines, since the cascaded first shift register units are disposed at the at least one edge of the non-display region along the second direction and hence the second shift register units disposed at both edges of the non-display region parallel to the first direction are reduced accordingly, the length of the second shift register unit in the first direction is properly increased to reduce the length of the second shift register unit in the second direction, narrowing the frame of the display panel employing the array substrate.

While multiple embodiments are disclosed, still other embodiments of the disclosure will become apparent to those skilled in the art from the following detailed description, which shows and describes illustrative embodiments of the disclosure. Accordingly, the drawings and detailed description are to be regarded as illustrative in nature and not restrictive.

Figure 1:
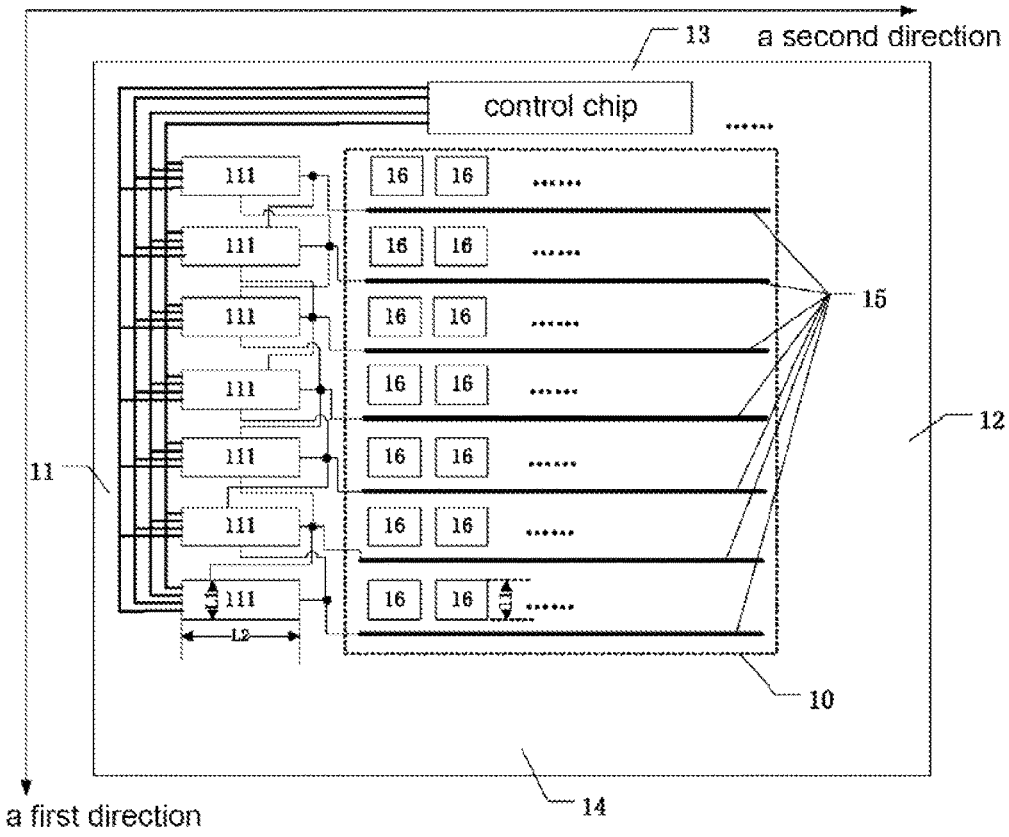
FIG. 1 is a schematic diagram of driving gates by an integrated gate driver in the related art.

While the disclosure is amenable to various modifications and alternative forms, specific embodiments have been shown by way of example in the drawings and are described in detail below. The intention, however, is not to limit the disclosure to the particular embodiments described. On the contrary, the disclosure is intended to cover all modifications, equivalents, and alternatives falling within the scope of the disclosure as defined by the appended claims.

DETAILED DESCRIPTION

The disclosure will be further described in detail below in combination with the accompanying drawings. It should be understood that the embodiments described herein are for illustrating the disclosure but not for limiting the same. It also should be noted that, for ease of description, the drawings illustrate some parts, but not all structures, associated with the disclosure.

Figure 3:
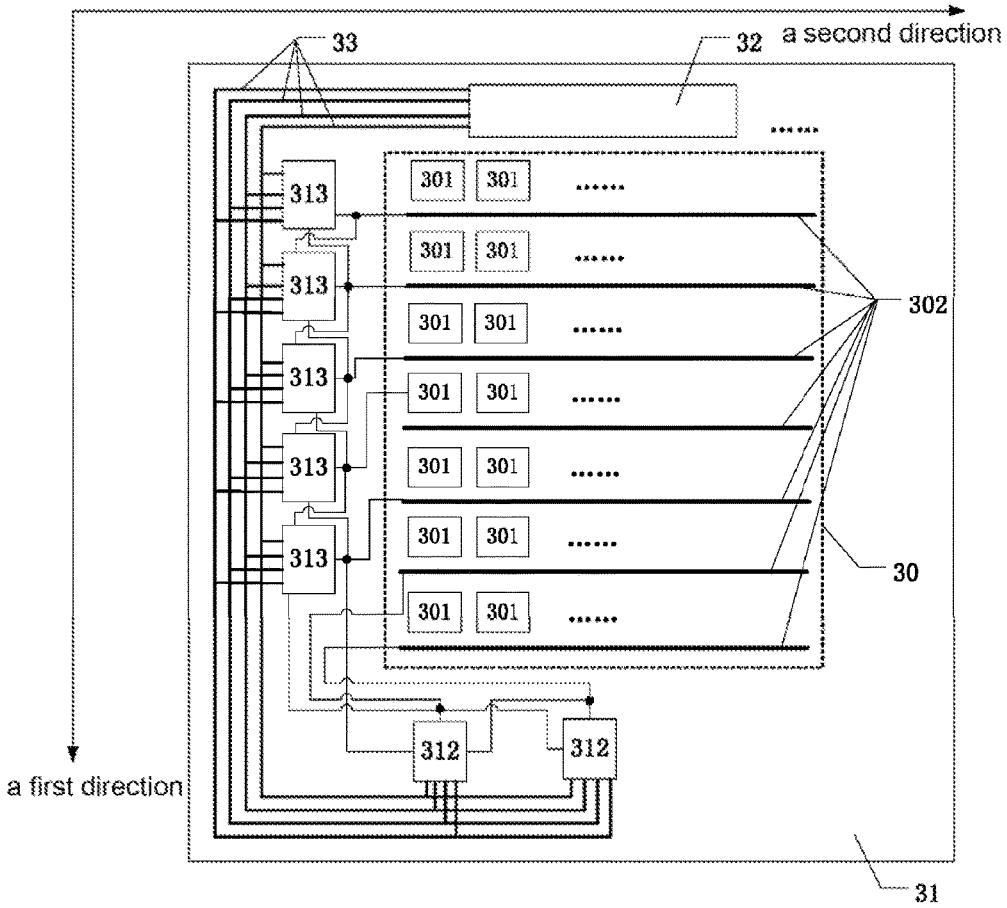
FIG. 3 is a schematic diagram showing the structure of an array substrate, according to embodiments of the disclosure.

FIG. 3 is a schematic diagram showing the structure of an array substrate, according to embodiments of the disclosure. As shown in FIG. 3, the array substrate includes a display region 30 for displaying an image and a non-display region 31 around the display region 30. The display region 30 includes a plurality of rows of pixel units 301 arranged sequentially along a first direction, and a plurality of gate scanning lines 302 corresponding to the plurality of rows of the pixel units 301, respectively. Each of the plurality of gate scanning lines 302 extends along a second direction and is configured for transmitting a scanning signal to a corresponding one of the rows of pixel units 301. Cascaded first shift register units 312 are disposed at at least one edge of the non-display region 31 parallel to the second direction, and each of the first shift register units 312 is connected with a corresponding one of the gate scanning lines 302. Further, cascaded second shift register units 313 are disposed at at least one edge of the non-display region 31 parallel to the first direction, and each of the second shift register units 313 is connected with a corresponding one of the gate scanning lines 302.

It should be noted that each of the first shift register units 312 and each of the second shift register units 313 may include active devices such as a plurality of thin film transistors or diodes and a passive device such as a capacitor, and the size of the first shift register unit 312 can be the same as or different from that of the second shift register unit 313, and the embodiments of the disclosure are not limited thereto.

Compared to the related art where a plurality of shift register units configured to output drive signals for controlling the gate switches are disposed at one edge of the non-display region 11 parallel to the first direction as shown in FIG. 1, embodiments of the disclosure propose that: the cascaded first shift register units 312 are disposed at at least one edge of the non-display region 31 parallel to the second direction, and each of the first shift register units 312 is connected with a corresponding one of the gate scanning lines 302, while the cascaded second shift register units 313 are disposed at at least one edge of the non-display region 31 parallel to the first direction, and each of the second shift register units 313 is connected with a corresponding one of the gate scanning lines 302. Therefore, the second shift register units 313 disposed at the edge of the non-display region 31 parallel to the first direction are reduced in the disclosure. Exemplarily, given the length L1 of the second shift register unit 313 along the first direction, the length L2 of the second shift register unit 313 along the second direction, and the length I1 of the pixel unit 301 along the first direction, the length L2 of each shift register unit along the second direction should meet a limitation of $L2=S/L1\geq S/I1$ in the related art, but in embodiments of the disclosure, the length L2 of the second shift register unit 313 along the second direction is not limited by $L2\geq S/I1$, since the cascaded first shift register units 312 are disposed at the at least one edge of the non-display region 31 along the second direction and hence the second shift register units 313 disposed at the at least one edge of the non-display region 31 parallel to the first direction are reduced accordingly in the second direction, thus achieving a further narrowed frame in the second direction.

On the basis of the above-described embodiments, in an implementation, a control chip 32 is disposed at a first edge of the non-display region 31 parallel to the second direction, while the cascaded first shift register units 312 are disposed at a second edge of the non-display region 31 parallel to the second direction. The benefits of this arrangement lie in that: the space at the first side of the non-display region, which is smaller, is used to arrange the control chip 32, while the second edge of the non-display region 31 parallel to the second direction, i.e. the side that is opposite to the control chip and has larger space, is used to arrange the cascaded first shift register units 312, so that more first shift register units may be thereby disposed, further reducing the second shift register units 313 disposed at the edge of the non-display region parallel to the first direction and thus narrowing the frame in the second direction.

The non-display region 31 also includes drive signal lines 33, which are connected with the control chip 32 and also respectively connected with the first shift register units 312 and the second shift register units 313. The drive signals 33 are configured for transmitting at least one of for example a clock signal, a gate cut-off voltage, a scan start signal, a low voltage, a high voltage to the first shift register units 312 and the second shift register units 313.

It should be noted that the cascaded first shift register units 312 can also be disposed at both edges of the non-display region parallel to the second direction, thus making the best of the space in the non-display region, further narrowing the frame in the second direction.

Further, in the above-described embodiments, the plurality of first shift register units are cascadedly-connected with the plurality of second shift register units, so that the first shift register units and the second shift register units are configured to receive the clock signal sequentially, and generate scanning signals and then sequentially transmit the respective generated scanning signals to the corresponding gate scanning lines.

Figure 4:
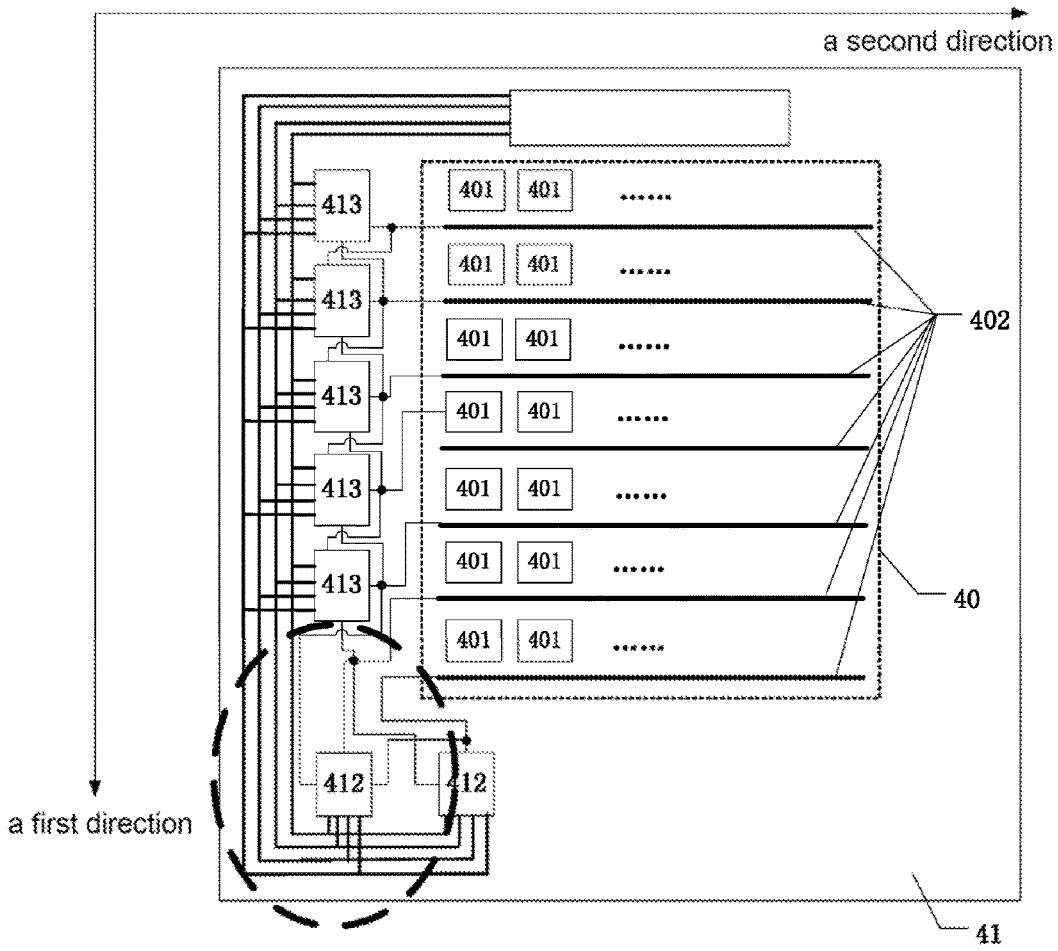
FIG. 4 is a schematic diagram showing the structure of another array substrate, according to embodiments of the disclosure.

FIG. 4 is a schematic diagram showing the structure of another array substrate, according to embodiments of the disclosure. As shown in FIG. 4, the array substrate includes a display region 40 for displaying an image and a non-display region 41 around the display region 40. The display region 40 includes a plurality of rows of pixel units 401 arranged sequentially along a first direction, and a plurality of gate scanning lines 402 corresponding to the plurality of rows of pixel units 401, respectively. Each of the plurality of gate scanning lines 402 extends along a second direction and is configured for transmitting a scanning signal to a corresponding one of the rows of pixel units 401. Cascaded first register units 412 are disposed at one edge of the non-display region 41 parallel to the second direction, and each of the first shift register units 412 is connected with a corresponding one of the gate scanning lines 402. Further, cascaded second register units 413 are disposed at one edge of the non-display region 41 parallel to the first direction, and each of the second shift register units 413 is connected with a corresponding one of the gate scanning lines 402. This is different from the above-described embodiments. In the embodiments shown in FIG. 3, the row of first shift register units 312 is aligned with a first end of each row of pixel units 301 along the second direction (for example, the first end of each row of pixel units 301 along the second direction as shown in FIG. 3); while in the embodiments of FIG. 4, the row of first shift register units 412 is aligned with a first side of the second register units 413 along the second direction (for example, the first side of the second register units 413 along the second direction as shown in FIG. 4). The benefits of this arrangement lie in that the overlapped region (as indicated by a dashed circle in FIG. 4) of the edges of the non-display region 41 along the first direction and the second direction can be utilized fully to dispose the first shift register units 412, and the second shift register units 413 disposed at the edge of the non-display region parallel to the first direction are further reduced, thereby further narrowing the frame in the second direction.

Figure 5:
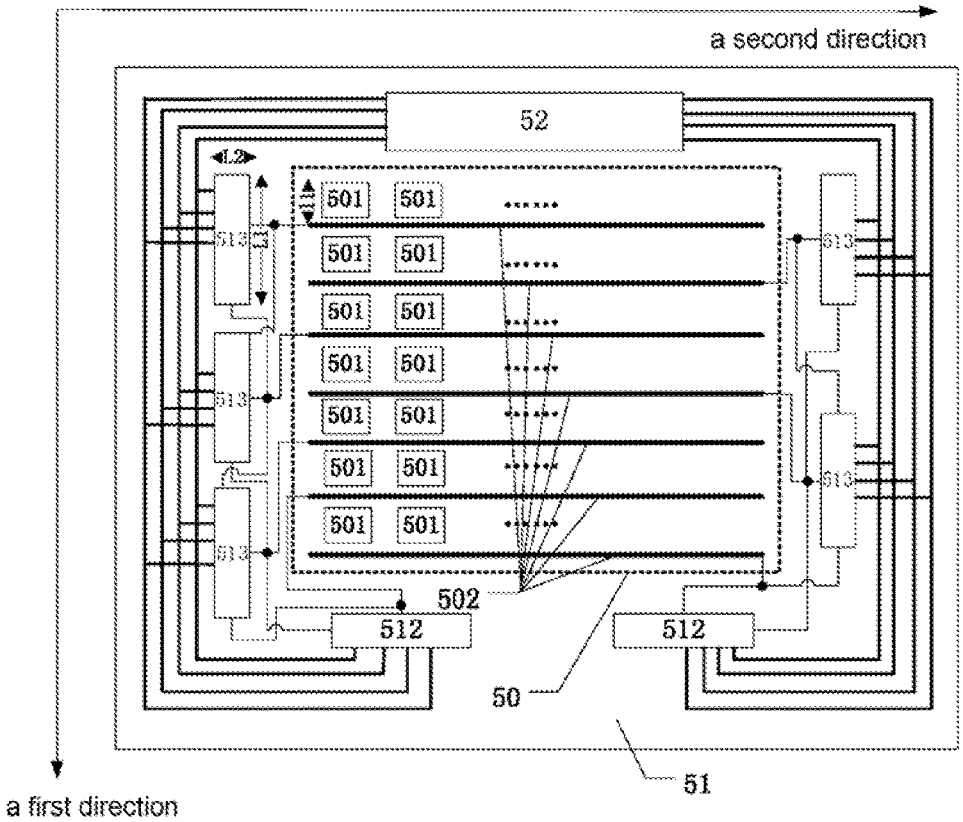
FIG. 5 is a schematic diagram showing the structure of still another array substrate, according to embodiments of the disclosure.

FIG. 5 is a schematic diagram showing the structure of still another array substrate, according to embodiments of the disclosure. As shown in FIG. 5, the array substrate includes a display region 50 for displaying an image and a non-display region 51 around the display region 50. The display region 50 includes a plurality of rows of pixel units 501 arranged sequentially along a first direction, and a plurality of gate scanning lines 502 corresponding to the plurality of rows of pixel units 501, respectively. Each of the plurality of gate scanning lines 502 extends along a second direction and is configured for transmitting a scanning signal to a corresponding one of the rows of pixel units 501. A control chip 52 is disposed at a first edge of the non-display region 51 parallel to the second direction, while the cascaded first shift register units 512 are disposed at a second edge of the non-display region 51 parallel to the second direction. Each of the first shift register units 512 is connected to one gate scanning line 502 corresponding to the first shift register unit 512. The cascaded second shift register units 513 are disposed at both edges of the non-display region 51 parallel to the first direction, i.e. the left side and the right side as shown in FIG. 5, and the second shift register units 513 disposed at the left side are connected to the odd-numbered gate scanning lines while the second shift register units 513 disposed at the right side are connected to the even-numbered gate scanning lines.

Figure 2:
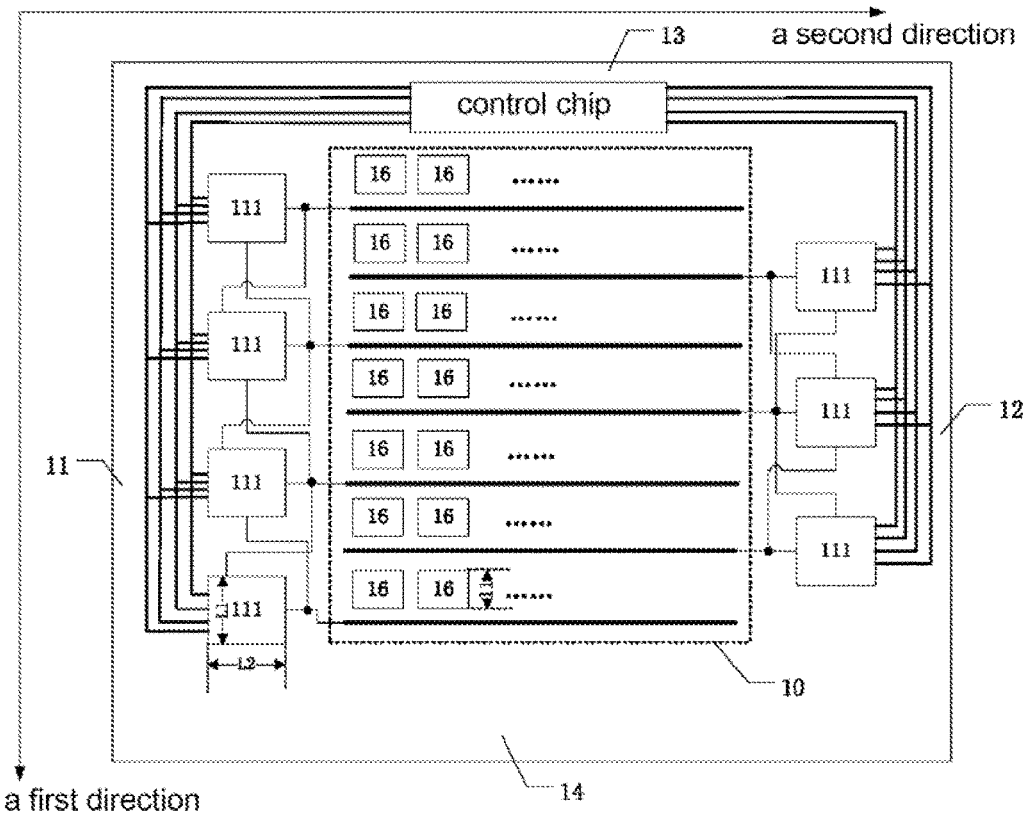
FIG. 2 is another schematic diagram of driving gates by an integrated gate driver in the related art.

Compared to the related art where a plurality of shift register units configured to output drive signals for controlling the gate switches are disposed at both edges of the non-display region 11 parallel to the first direction as shown in FIG. 2, embodiments of the disclosure propose that: the cascaded first shift register units 512 are disposed at the second edge of the non-display region 51 parallel to the second direction, and each of the first shift register units 512 is connected with a corresponding one of the gate scanning lines 502; and the cascaded second shift register units 513 are disposed at both edges of the non-display region 51 parallel to the first direction and connected to the odd-numbered gate scanning lines and the even-numbered gate scanning lines, respectively. Compared to the number of the shift register units disposed in the non-display regions 11 and 12 as shown in FIG. 2, the embodiments of FIG. 5 are advantageous in that: the number of the second shift register units 513 disposed at both edges of the non-display region 51 parallel to the first direction is significantly reduced. Exemplarily, given the length L1 of the second shift register unit 513 along the first direction, the length L2 of the second shift register unit 513 along the second direction, and the length I1 of the pixel unit 501 along the first direction, the length L2 of each shift register unit along the second direction should meet a limitation of $L2=S/L1\geq S/2I1$ in the related art as shown in FIG. 2, but in the embodiments of the disclosure, the length L2 of the second shift register unit 513 along the second direction is not limited by $L2\geq S/I1$, since the cascaded first shift register units 512 are disposed at the edge of the non-display region 51 along the second direction and hence the second shift register units 513 disposed at each edge of the non-display region 51 parallel to the first direction are reduced accordingly in the second direction, that is, the length, in the first direction, of each of the second shift register units 513 disposed at each edge of the non-display region parallel to the first direction is allowed to be larger than the length of two rows of pixel units in the first direction. Given the constant area of the second shift register unit 513 and the increased length of the second shift register unit in the first direction, the length of the second shift register unit 513 in the second direction can be reduced, thus further narrowing the frame in the second direction.

On the basis of the above-described embodiments, if the cascaded second shift register units 513 are disposed in both edges of the non-display region 51 parallel to the first direction, at least one set of the first shift register units 512 for driving some odd-numbered gate scanning lines and at least one set of the first shift register units 512 for driving some even-numbered gate scanning lines are disposed at the second edge of the non-display region 51 parallel to the second direction. The at least one set of the first shift register units 512 for driving the odd-numbered gate scanning lines are cascadedly connected with the second shift register units 513 for driving the other odd-numbered gate scanning lines, and the at least one set of the first shift register units 512 for driving the even-numbered gate scanning lines are cascadedly connected with the second shift register units 513 for driving the other even-numbered gate scanning lines.

Figure 6:
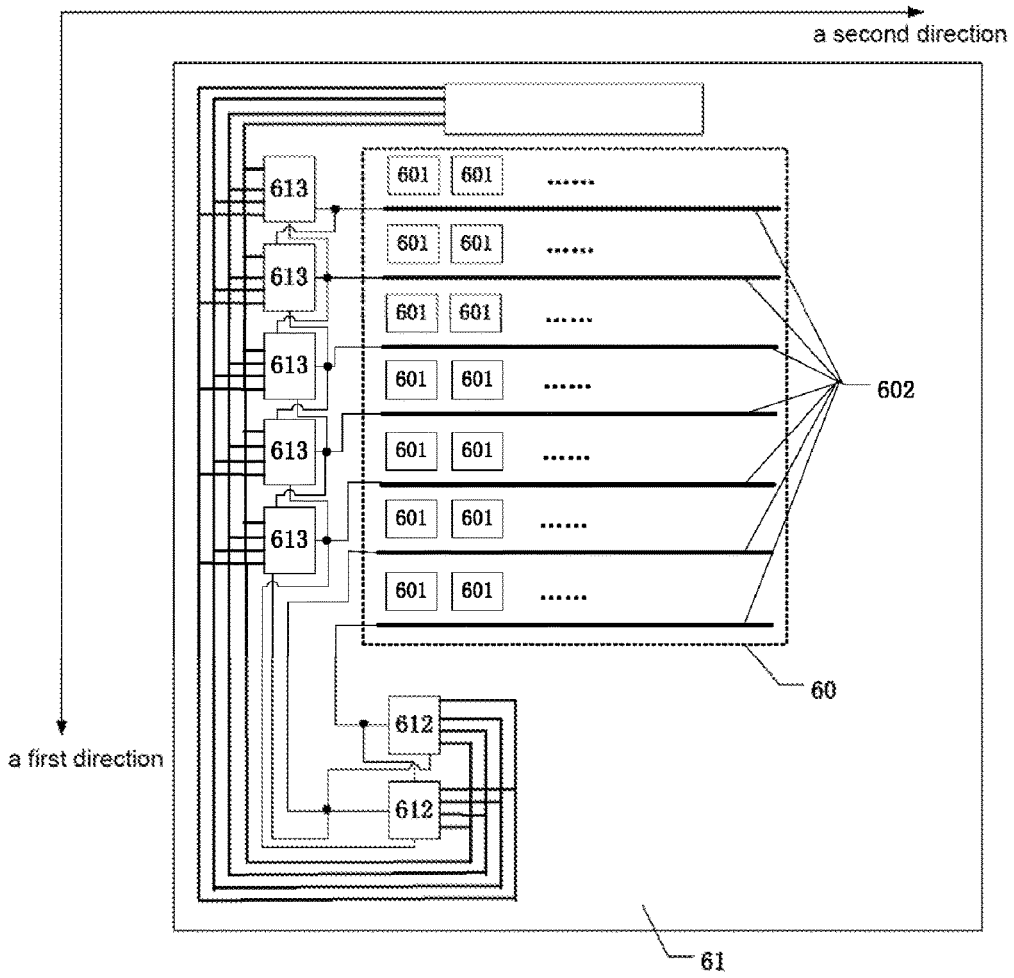
FIG. 6 is a schematic diagram showing an arrangement of first shift register units, according to embodiments of the disclosure.

It should be noted that the cascaded first shift register units 512 disposed at the second edge of the non-display region parallel to the second direction can be arranged sequentially along the second direction as shown in FIG. 3, or along the first direction. FIG. 6 is a schematic diagram showing an arrangement of first shift register units 612, according to embodiments of the disclosure. As shown in FIG. 6, the array substrate includes a display region 60 for displaying an image and a non-display region 61 around the display region 60. The display region 60 includes a plurality of rows of pixel units 601 arranged sequentially along a first direction, and a plurality of gate scanning lines 602 corresponding to the plurality of rows of the pixel units 601, respectively. Each of the plurality of gate scanning lines 602 extends along a second direction and is configured for transmitting a scanning signal to a corresponding one of the rows of pixel units 601. Cascaded first shift register units 612 are disposed at one edge of the non-display region 61 parallel to the second direction, and each of the first shift register units 612 is connected with a corresponding one of the gate scanning lines 602. Cascaded second shift register units 613 are disposed at one edge of the non-display region 61 parallel to the first direction, and each of the second shift register units 613 is connected with a corresponding one of the gate scanning lines 602. Unlike in the above-described embodiments, the cascaded first shift register units 612 disposed at the edge of the non-display region 61 parallel to the second direction are arranged sequentially along the first direction.

Figure 7:
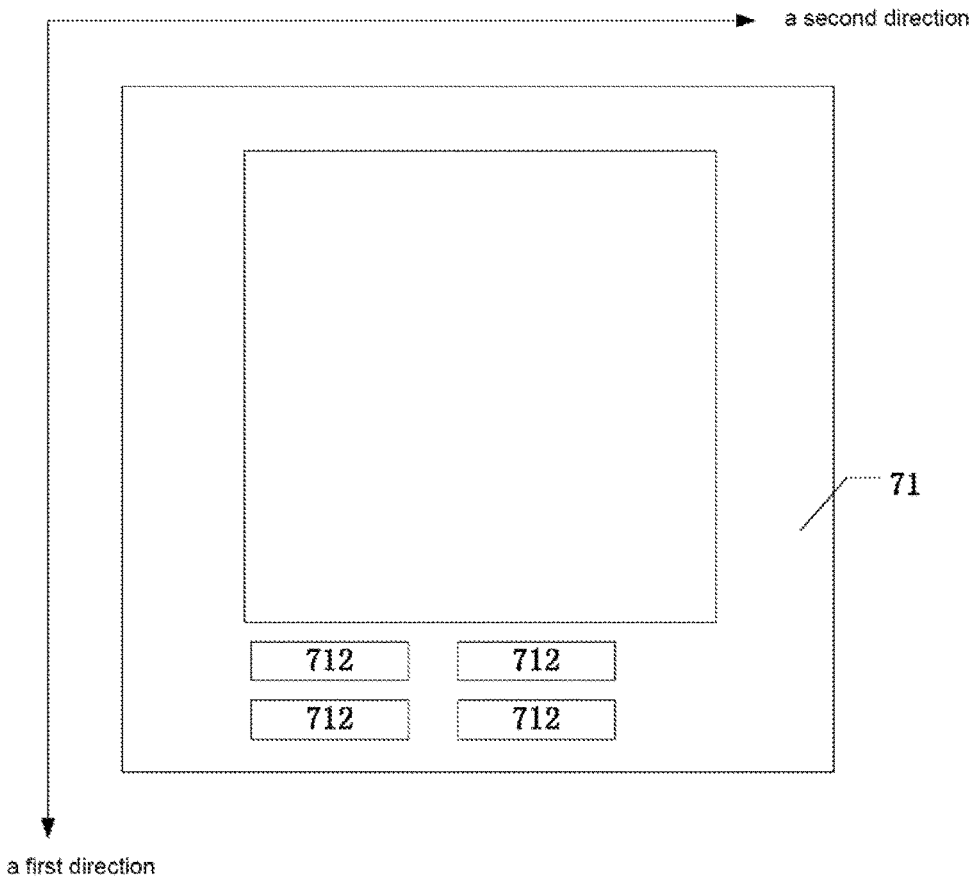
FIG. 7 is a schematic diagram showing another arrangement of first shift register units, according to embodiments of the disclosure.

FIG. 7 is a schematic diagram showing another arrangement of first shift register units 712, according to embodiments of the disclosure. As shown in FIG. 7, the cascaded first shift register units 712 disposed at a second edge of the non-display region 71 parallel to the second direction are arranged as a matrix.

Figure 8:
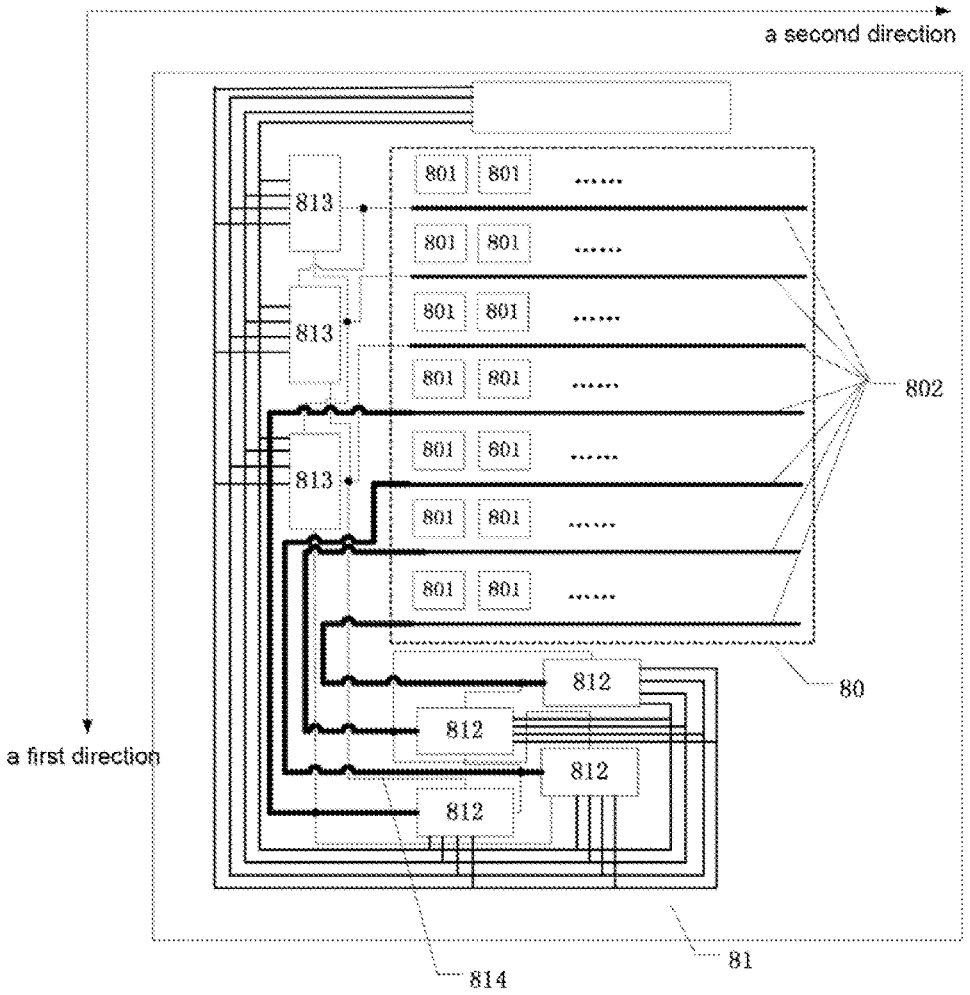
FIG. 8 is a schematic diagram showing still another arrangement of first shift register units, according to embodiments of the disclosure.

FIG. 8 is a schematic diagram showing still another arrangement of first shift register units, according to embodiments of the disclosure. As shown in FIG. 8, the array substrate includes a display region 80 for displaying an image and a non-display region 81 around the display region 80. The display region 80 includes a plurality of rows of pixel units 801 arranged sequentially along a first direction, and a plurality of gate scanning lines 802 corresponding to the plurality of rows of the pixel units 801, respectively. Each of the plurality of gate scanning lines 802 extends along a second direction and is configured for transmitting a scanning signal to a corresponding one of the plurality of rows of pixel units 801. Cascaded first shift register units 812 are disposed at one edge of the non-display region 81 parallel to the second direction, and each of the first shift register units 812 is connected with a corresponding one of the gate scanning lines 802. Cascaded second shift register units 813 are disposed at one edge of the non-display region 81 parallel to the first direction, and each of the second shift register units 813 is connected with a corresponding one of the gate scanning lines 802. The cascaded first shift register units 812 disposed at the edge of the non-display region 81 parallel to the second direction are arranged as a matrix, with different columns of the first shift register units being staggered. The projections of connecting lines between any adjacent two first shift register units 812 and of a connecting line between any first shift register unit 812 and the corresponding gate scanning line 802 onto the array substrate do not overlap the projection of any of the first shift register units 812 onto the array substrate, so that the interference between the connecting lines and the adjacent first shift register units can be avoided. Although FIG. 8 exemplarily shows two-row and two-column first shift register units, the embodiments of the disclosure are not limited thereto.

Figure 9:
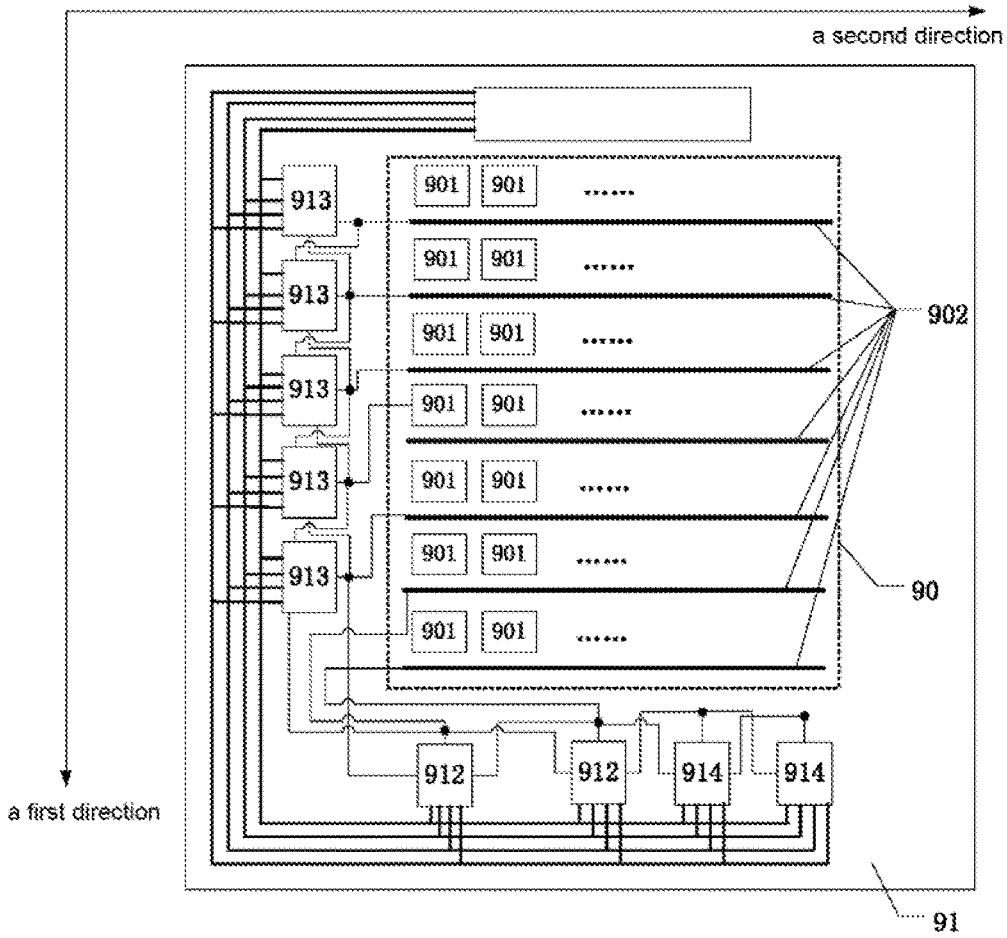
FIG. 9 is a schematic diagram showing the structure of yet another array substrate, according to embodiments of the disclosure.

FIG. 9 is a schematic diagram showing the structure of yet another array substrate, according to embodiments of the disclosure. As shown in FIG. 9, the array substrate includes a display region 90 for displaying an image and a non-display region 91 around the display region 90. The display region 90 includes a plurality of rows of pixel units 901 arranged sequentially along a first direction, and a plurality of gate scanning lines 902 corresponding to the plurality of rows of the pixel units 901, respectively. Each of the plurality of gate scanning lines 902 extends along a second direction and is configured for transmitting a scanning signal to a corresponding one of the plurality of rows of pixel units 901. Cascaded first shift register units 912 are disposed at a second edge of the non-display region 91 parallel to the second direction, and each of the first shift register units 912 is connected with a corresponding one of the gate scanning lines 902. Cascaded second shift register units 913 are disposed at one edge of the non-display region 91 parallel to the first direction, and each of the second shift register units 913 is connected with a corresponding one of the gate scanning lines 902. Unlike in the above-described embodiments, a plurality of virtual shift register units 914 are also disposed at the second edge of the non-display region 91 parallel to the second direction and are cascadedly connected with the first shift register units 912, to preprocess the scan signals to be inputted, thus ensuring the accuracy of the inputted scan signals. Although FIG. 9 exemplarily shows two virtual shift register units 914, the disclosure is not limited thereto. In other embodiments, the number of the virtual shift register units can be varied with the practical requirement.

Figure 10:
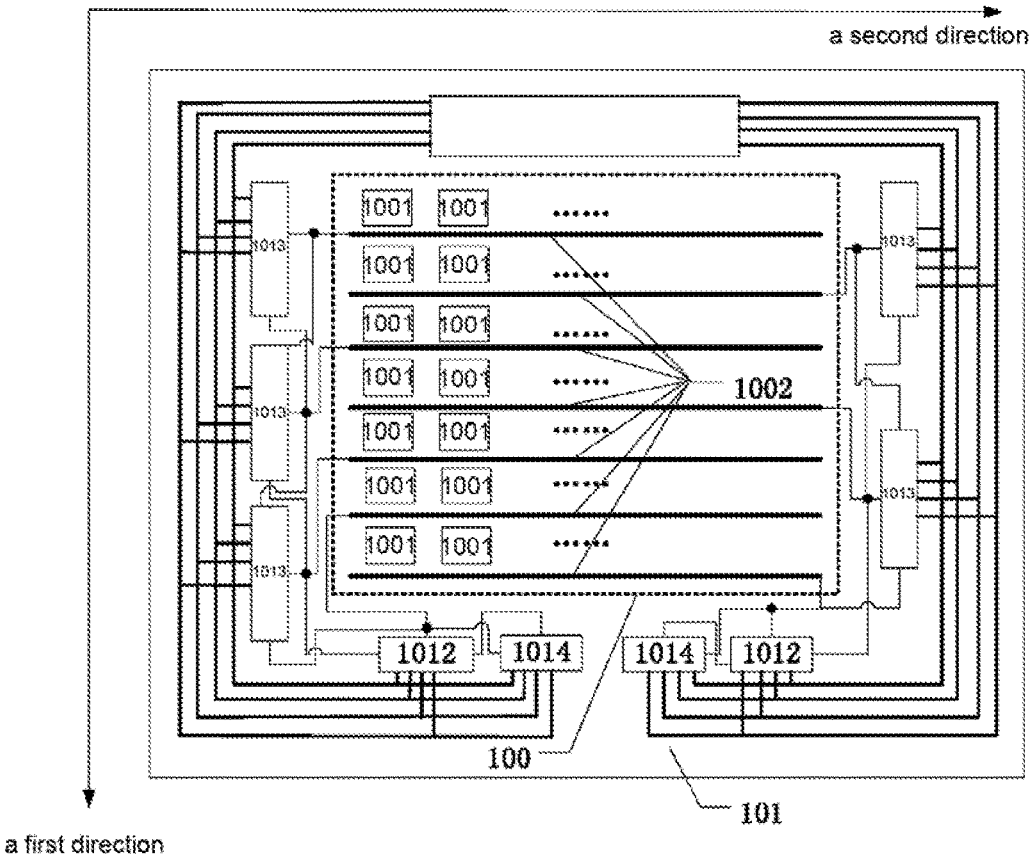
FIG. 10 is a schematic diagram showing the structure of another array substrate, according to embodiments of the disclosure.

FIG. 10 is a schematic diagram showing the structure of another array substrate, according to embodiments of the disclosure. As shown in FIG. 10, the array substrate includes a display region 100 for displaying an image and a non-display region 101 around the display region 100. The display region 100 includes a plurality of rows of pixel units 1001 arranged sequentially along a first direction, and a plurality of gate scanning lines 1002 corresponding to the plurality of rows of the pixel units 1001, respectively. Each of the plurality of gate scanning lines 1002 extends along a second direction and is configured for transmitting a scanning signal to a corresponding one of the rows of pixel units 1001. A control chip 102 is disposed at a first edge of the non-display region 101 parallel to the second direction, while cascaded first shift register units 1012 are disposed at a second edge of the non-display region 101 parallel to the second direction. Each of the first shift register units 1012 is connected with a corresponding one of the plurality of gate scanning lines 1002. Cascaded second shift register units 1013 are disposed at both edges of the non-display region 101 parallel to the first direction, e.g. left and right edges of the non-display region 101 parallel to the first direction, and the second shift register units 1013 disposed at the left edge of the non-display region 101 are connected to the odd-numbered gate scanning lines, while the second shift register units 1013 disposed at the right edge of the non-display region 101 are connected to the even-numbered gate scanning lines. The cascaded first shift register units 1012 disposed at the second edge of the non-display region 101 parallel to the second direction include at least one set of the first shift register units 1012 for driving the odd-numbered gate scanning lines and at least one set of the first shift register units 1012 for driving the even-numbered gate scanning lines. The at least one set of the first shift register units 1012 for driving the odd-numbered gate scanning lines are cascadedly connected with the second shift register units 1013 for driving the other odd-numbered gate scanning lines, and the at least one set of the first shift register units 1012 for driving the even-numbered gate scanning lines are cascadedly connected with the second shift register units 1013 for driving the other even-numbered gate scanning lines.

Moreover, at least one set of virtual shift register units 1014 are also disposed at the second edge of the non-display region 101 parallel to the second direction. The at least one set of virtual shift register units 1014 are disposed between at least one column of the second shift register units 1013 for driving the odd-numbered gate scanning lines and at least one column of the second shift register units 1013 for driving the odd-numbered gate scanning lines, and are cascadedly connected with the at least one set of the first shift register units 1012 for driving the odd-numbered gate scanning lines and the at least one set of the first shift register units 1012 for driving the even-numbered gate scanning lines, respectively.

It should be noted that each of the first shift register units and each of the second shift register units may include active devices such as a plurality of thin film transistors or diodes and a passive device such as a capacitor, and the size of the first shift register unit can be the same as or different from that of the second shift register unit, and the embodiments of the disclosure are not limited thereto.

Figure 11:
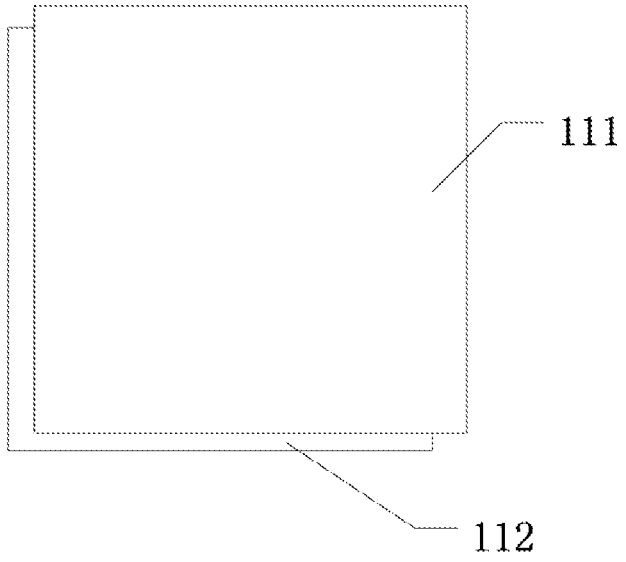
FIG. 11 is a schematic diagram showing the structure of a display panel, according to embodiments of the disclosure.

Embodiments of the disclosure further provide a display panel. FIG. 11 is a schematic diagram showing the structure of a display panel, according to embodiments of the disclosure. As shown in FIG. 11, the display panel includes a color filter substrate 111 and the array substrate 112 according to the above-described embodiments. Due to the employment of the array substrate according to the above-described embodiments in the display panel, the display panel also has the same beneficial effects as the above-described array substrates.

Embodiments of the disclosure further provide a liquid crystal display device including the display panel according to the above-described embodiments. It should be noted that the liquid crystal display device further includes additional means for supporting the normal operation of the liquid crystal display device. The liquid crystal display device can be any one of mobile phones, tablet computers, electronic paper, and electronic photo frames.

Although some embodiments of the disclosure and the technical principles employed therein have been described as above, the disclosure is not limited to the specific embodiments described herein. Various alterations, readjustments and alternations may be made out without departing from the protection scope of the disclosure. Therefore, the disclosure has been described in detail by the above embodiments, but the disclosure is not limited to the above embodiments and also includes more other embodiments without departing from the concept of the disclosure.

Various modifications and additions can be made to the exemplary embodiments discussed without departing from the scope of the disclosure. For example, while the embodiments described above refer to particular features, the scope of this disclosure also includes embodiments having different combinations of features and embodiments that do not include all of the described features. Accordingly, the scope of the disclosure is intended to embrace all such alternatives, modifications, and variations as fall within the scope of the claims, together with all equivalents thereof.

We claim:

1. An array substrate, comprising a display region and a non-display region around the display region;

wherein the display region comprises a plurality of rows of pixel units arranged sequentially along a first direction and a plurality of gate scanning lines connected to the plurality of rows of the pixel units, respectively, and the plurality of gate scanning lines extend along a second direction;

cascaded first shift register units are disposed at at least one edge of the non-display region parallel to the second direction, and each of the cascaded first shift register units is connected with one of the plurality of gate scanning lines;

cascaded second shift register units are disposed at at least one edge of the non-display region parallel to the first direction, and each of the cascaded second shift register units is connected with one of the plurality of gate scanning lines; and at least one virtual shift register unit is disposed at a first edge of the non-display region parallel to the second direction and is cascadedly connected with the cascaded first shift register units.

2. The array substrate of claim 1, wherein the cascaded first shift register units are cascadedly connected with the second shift register units.

3. The array substrate of claim 1, wherein the cascaded second shift register units are disposed at both edges of the non-display region parallel to the first direction, cascaded second shift register units disposed at one of the both edges of the non-display region parallel to the first direction are connected with odd-numbered gate scanning lines, and cascaded second shift register units disposed at the other of the both edges of the non-display region parallel to the first direction are connected with even-numbered gate scanning lines.

4. The array substrate of claim 1, wherein a control chip is disposed at a second edge of the non-display region parallel to the second direction, while the cascaded first shift register units are disposed at the first edge of the non-display region parallel to the second direction.

5. The array substrate of claim 4, wherein the cascaded first shift register units disposed at the first edge of the non-display region parallel to the second direction are arranged sequentially along the first direction.

6. The array substrate of claim 4, wherein the cascaded first shift register units disposed at the first edge of the non-display region parallel to the second direction are arranged sequentially along the second direction.

7. The array substrate of claim 4, wherein the cascaded first shift register units disposed at the first edge of the non-display region parallel to the second direction are arranged as a matrix.

8. The array substrate of claim 7, wherein different columns of the cascaded first shift register units are staggered, projections of connecting lines between any adjacent two of the cascaded first shift register units onto the array substrate do not overlap a projection of any of the cascaded first shift register units onto the array substrate, and projection of a connecting line between any of the cascaded first shift register units and a gate scanning line connected to the any of the cascaded first shift register units onto the array substrate do not overlap the projection of any of the cascaded first shift register units onto the array substrate.

9. The array substrate of claim 3, wherein at least one set of the cascaded first shift register units for driving the odd-numbered gate scanning lines and at least one set of the cascaded first shift register units for driving the even-numbered gate scanning lines are disposed at the first edge of the non-display region parallel to the second direction, the at least one set of the cascaded first shift register units for driving the odd-numbered gate scanning lines are cascadedly connected with the cascaded second shift register units for driving the odd-numbered gate scanning lines, and the at least one set of the first cascaded shift register units for driving the even-numbered gate scanning lines are cascadedly connected with the cascaded second shift register units for driving the even-numbered gate scanning lines.

10. The array substrate of claim 1, wherein the cascaded second shift register units are disposed at both edges of the non-display region parallel to the first direction, and at least one set of virtual shift register units disposed between at least one column of cascaded second shift register units for driving odd-numbered gate scanning lines and at least one column of cascaded second shift register units for driving even-numbered gate scanning lines, at least one virtual shift register unit of the at least one set of virtual shift register units is cascadedly connected with at least one set of the cascaded first shift register units for driving the odd-numbered gate scanning lines, and at least one virtual shift register unit of the at least one set of virtual shift register units is cascadedly connected with at least one set of the cascaded first shift register units for driving the even-numbered gate scanning lines.

11. The array substrate of claim 1, wherein the cascaded second shift register units are disposed at both edges of the non-display region parallel to the first direction, and a length of each of the cascaded second shift register units in the first direction is larger than a length of two rows of pixel units in the first direction.

12. The array substrate of claim 1, wherein the cascaded second shift register units are disposed at one edge of the non-display region parallel to the first direction, a length of each of the cascaded second shift register units in the first direction is larger than a length of one row of pixel units in the first direction.

13. The array substrate of claim 4, wherein the non-display region further comprises drive signal lines connected with the control chip, and the drive signal lines are further connected with the cascaded first shift register units and the cascaded second shift register units.

14. The array substrate of claim 1, wherein a row of the cascaded first shift register units is aligned with an end of each row of the pixel units along the second direction.

15. The array substrate of claim 1, wherein a row of the cascaded first shift register units is aligned with a side of the second register units along the second direction.

16. A display panel comprising a color filter substrate and an array substrate, wherein the array substrate comprising a display region and a non-display region around the display region;

wherein the display region comprises a plurality of rows of pixel units arranged sequentially along a first direction and a plurality of gate scanning lines connected to the plurality of rows of the pixel units, respectively, and the plurality of gate scanning lines extend along a second direction;

cascaded first shift register units are disposed at at least one edge of the non-display region parallel to the second direction, and each of the cascaded first shift register units is connected with one of the plurality of gate scanning lines;

cascaded second shift register units are disposed at at least one edge of the non-display region parallel to the first direction, and each of the cascaded second shift register units is connected with one of the plurality of gate scanning lines; and at least one virtual shift register unit is disposed at a first edge of the non-display region parallel to the second direction and is cascadedly connected with the cascaded first shift register units.

17. A liquid crystal display device comprising a display panel, wherein the display panel comprising a color filter substrate and an array substrate, wherein the array substrate comprising a display region and a non-display region around the display region;

wherein the display region comprises a plurality of rows of pixel units arranged sequentially along a first direction and a plurality of gate scanning lines connected to the plurality of rows of the pixel units, respectively, and the plurality of gate scanning lines extend along a second direction;

cascaded first shift register units are disposed at at least one edge of the non-display region parallel to the second direction, and each of the cascaded first shift register units is connected with one of the plurality of gate scanning lines;

cascaded second shift register units are disposed at at least one edge of the non-display region parallel to the first direction, and each of the cascaded second shift register units is connected with one of the plurality of gate scanning lines; and at least one virtual shift register unit is disposed at a first edge of the non-display region parallel to the second direction and is cascadedly connected with the cascaded first shift register units.

* * * * *